US006285946B1

(12) United States Patent
Steinmann

(10) Patent No.: US 6,285,946 B1
(45) Date of Patent: Sep. 4, 2001

(54) METHOD AND DEVICE FOR CONTROLLING A DRIVE UNIT OF A VEHICLE

(75) Inventor: Berthold Steinmann, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/341,046

(22) PCT Filed: Jun. 29, 1998

(86) PCT No.: PCT/DE98/01778

§ 371 Date: Jul. 1, 1999

§ 102(e) Date: Jul. 1, 1999

(87) PCT Pub. No.: WO99/23379

PCT Pub. Date: May 14, 1999

(30) Foreign Application Priority Data

Nov. 3, 1997 (DE) ..... 197 48 355

(51) Int. Cl.[7] ..... F02D 41/14; F02D 41/06

(52) U.S. Cl. ..... 701/110; 123/333; 123/350

(58) Field of Search ..... 701/110; 123/350, 123/325, 326, 333

(56) References Cited

U.S. PATENT DOCUMENTS

| | | | | |
|---|---|---|---|---|
| 5,457,633 | | 10/1995 | Palmer et al. | 701/112 |
| 5,499,952 | * | 3/1996 | Huber et al. | 477/115 |
| 5,692,472 | | 12/1997 | Bederna et al. | 123/350 |

FOREIGN PATENT DOCUMENTS

| | | |
|---|---|---|
| 02 024078 | 3/1990 | (JP) . |
| 04 203251 | 11/1992 | (JP) . |
| 09 229170 | 1/1998 | (JP) . |

* cited by examiner

*Primary Examiner*—Andrew M. Dolinar
(74) *Attorney, Agent, or Firm*—Walter Ottesen

(57) ABSTRACT

A method and an arrangement for controlling the drive unit of a vehicle are suggested wherein a maximum permissible torque is pregiven and, when this maximum permissible torque is exceeded, the torque of the drive unit is reduced. The maximum permissible torque is formed at least in dependence upon the position of the operator-controlled element. The maximum permissible torque is dependent upon the desired torque of at least one external function when this desired torque is greater than the permissible torque dependent upon the position of the operator-controlled element.

6 Claims, 2 Drawing Sheets

METHOD AND DEVICE FOR CONTROLLING A DRIVE UNIT OF A VEHICLE

FIELD OF THE INVENTION

The invention relates to a method and an arrangement for controlling the drive unit of a motor vehicle.

BACKGROUND OF THE INVENTION

A method and an arrangement for controlling the drive unit of a motor vehicle is known from U.S. Pat. No. 5,692,472. Here, a torque of the drive unit is controlled in dependence upon a desired value for this torque. To ensure the operational reliability of this control system, a maximum permissible torque of the drive unit is also formed and is compared to an actual torque of the drive unit and fault reaction measures are initiated when the actual torque of the drive unit exceeds the maximum permissible torque. In an embodiment described there, the maximum permissible torque is formed in dependence upon the desired torque value. This value, in turn, is computed on the basis of the position of an operator-controlled element, such as an accelerator pedal, which is operable by the driver, or is computed in dependence upon the desired torque pregiven by other control systems or control functions, for example, in dependence upon a desired torque of an engine drag torque control and/or of an idle rpm control. The maximum permissible torque is formed by means of a characteristic line or a characteristic field in dependence upon the desired torque value. There is no description of a consideration of the tolerances of the drive unit which, for example, are caused by internal friction. Furthermore, the permissible torque is dependent upon the driver command torque so that the permissible torque is likewise defective for a theoretically conceivable error in the computation of this torque.

SUMMARY OF THE INVENTION

It is an object of the invention to provide measures for monitoring an engine control on the basis of a maximum permissible torque via which this monitoring is optimized.

ADVANTAGES OF THE INVENTION

The monitoring of a control of a drive unit on a drive torque basis is significantly improved because tolerances are considered in the formation of the maximum permissible torque which is the basis of the monitoring. The tolerances are considered even when external interventions operate.

A formation of the maximum permissible torque, which is independent of the pedal characteristic, is achieved by the application of desired torques when forming the maximum permissible torque. The desired torques are pregiven by external functions. In this way, the torque monitoring while considering the tolerances is also then possible when external functions operate and the driver releases the pedal in the extreme case (for example, road speed control operation, engine drag torque control operation, et cetera).

Furthermore, it is advantageous that the driver command is not included in the computation of the permissible torque.

BRIEF DESCRIPTION OF THE DRAWINGS

The invention will be explained in greater detail in the following with respect to the embodiments shown in the drawing.

DESCRIPTION OF THE PREFERRED EMBODIMENTS OF THE INVENTION

Figure 1:
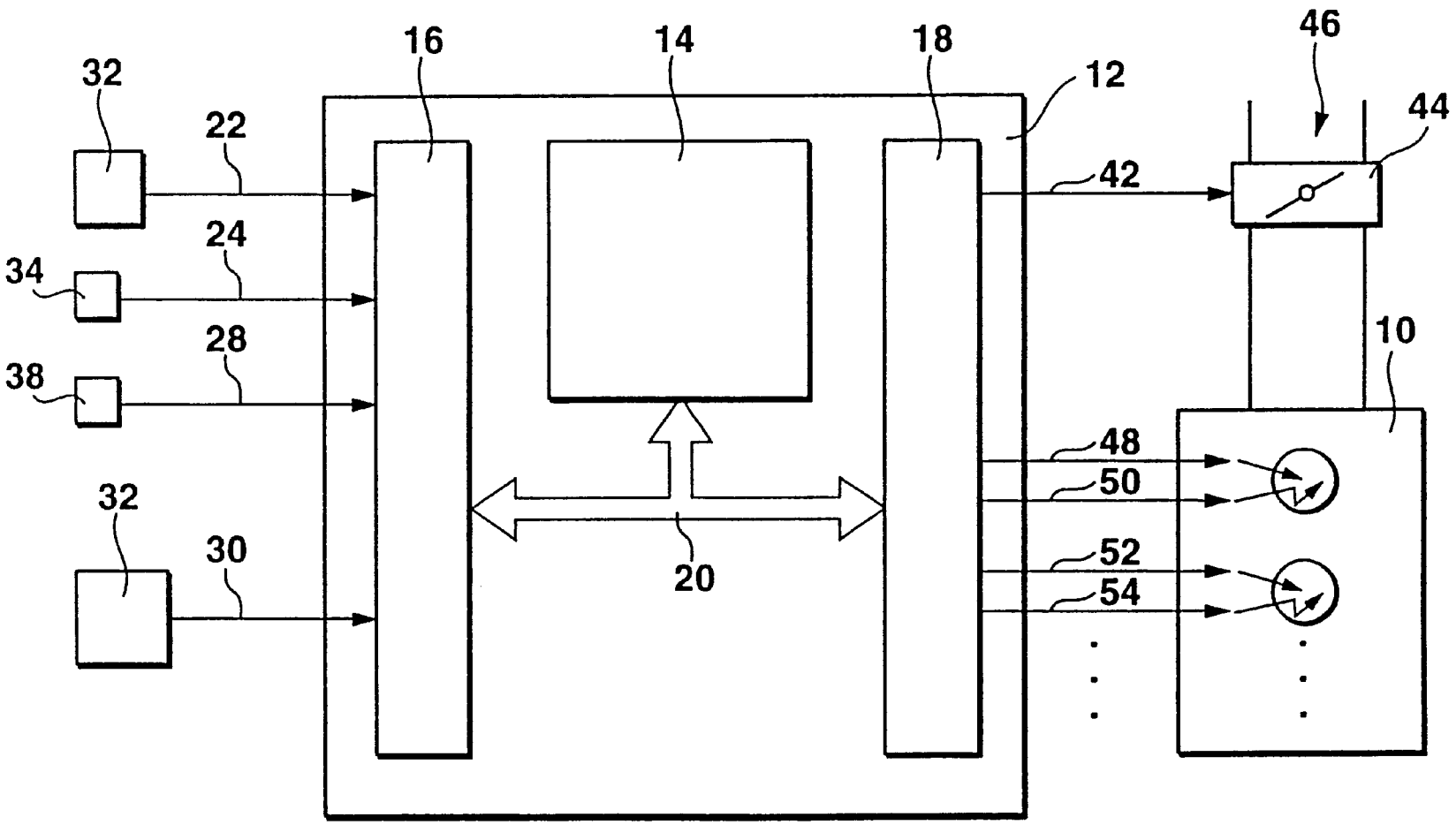
FIG. 1 shows an overview of a control unit for controlling the torque of the drive unit; whereas, in FIG. 2, a preferred embodiment is shown in the form of a sequence diagram for monitoring the control on the basis of torque.

In FIG. 1, a control arrangement for a multi-cylinder internal combustion engine 10 is shown. The control arrangement includes an electronic control apparatus 12 which comprises at least a microcomputer 14, an input unit 16 and an output unit 18. The input unit 16, output unit 18 and the at least one microcomputer 14 are connected to each other via a communication bus 20 for mutual data exchange. The input lines 22, 24, 28 and 30 lead to the input unit 16. The line 22 originates at a measuring device 32 for detecting the pedal position and the line 24 originates at a measuring device 34 for detecting the engine rpm. The line 28 originates at a measuring device 38 for detecting a quantity representing the engine load and the line 30 originates at at least one additional control apparatus 40, for example, a control apparatus for drive slip control, transmission control, for engine drag torque control, for road speed control, et cetera. Depending upon the embodiment, an air mass sensor, an air quantity sensor or a pressure sensor for detecting the intake manifold pressure are provided for detecting the quantity representing engine load. In addition to the illustrated operating quantity, the control apparatus detects additional quantities, which are essential for engine control, such as engine temperature, road speed, the time after start, inducted air temperature, et cetera.

An output line 42 is connected to the output unit 18 and leads to an electrically actuable throttle flap 44 which is mounted in the air intake system 46 of the internal combustion engine. Furthermore, output lines 48, 50, 52, 54, et cetera are shown which are connected to actuating devices for fuel metering in each cylinder of the engine 10 or for adjusting the ignition angle in each cylinder.

The engine control described above is realized by programs of the microcomputer. The engine control takes place by coordinating the charge intervention (air intervention), the ignition angle adjustment and the change of the fuel metering (suppression of individual cylinders, shifting the air/fuel composition) on the basis of the torque of the drive unit. A desired torque is selected for controlling the drive unit in dependence upon the driver command as well as corresponding signals of additional control units 40. The driver command is determined by the position of the pedal. This desired torque is converted into a desired value for the charge to be adjusted, into an ignition angle correction and/or a fuel metering correction. In this way, the torque of the drive unit is made to approach the pregiven desired torque.

To ensure the operational reliability, it is further provided to determine the actual torque of the drive unit on the basis of operating variables such as engine rpm, the quantity representing the load, the actual ignition angle position and the fuel metering adjustment in the manner described in the initially mentioned state of the art. Furthermore, a maximum permissible torque is formed and compared to the actual torque and a torque reduction is carried out when the actual torque exceeds the maximal permissible torque. In a preferred embodiment, at least two program levels are provided in the microcomputer 14 which operate separately from each other. The described torque monitoring takes place in a higher order monitoring level; whereas, the above-described engine control is computed in a so-called function level. Furthermore, the desired torque value for the control of the torque of the drive unit is limited in dependence upon a maximum torque in order to avoid the safety function. The safety function is triggered on the basis of the torque comparison as long as the actual torque exceeds the permissible torque and is realized preferably by switching off the fuel metering. This maximum torque is, as a rule, less in magnitude than the maximum permissible torque so that the safety reaction takes place only when a fault state is actually present.

With the determination of the maximum permissible torque, the maximum permissible torque is read out of at least one characteristic field on the basis of the accelerator pedal position and the engine rpm. The essential tolerances are considered in the characteristic field and the maximum permissible torque is determined as shown below on the basis of the sequence diagram of FIG. 2. Furthermore, and in a preferred embodiment, a further characteristic field is provided which considers the increased tolerances especially as a consequence of friction. The characteristic field considers these increased tolerances after the start of the drive unit and especially for a cold drive unit. This maximum permissible torque in the poststart is likewise determined in dependence upon the accelerator pedal position and the engine rpm in accordance with a further characteristic field. A switchover to this characteristic field takes place when, after start, certain conditions are present such as the temperature of the engine, the intake air temperature and/or the time elapsed after start lie within pregiven value ranges.

The maximum permissible torque determined in this manner is applied to the above-mentioned torque monitoring and/or for limiting the desired torque. The maximum permissible torque is dependent upon driver command. If functions are active which replace the driver command or increase or reduce the torque relative to the driver command, the maximum permissible torque, which is formed in the manner described above, does not reflect the actual situation of the control. This is especially significant for interventions which increase the torque of the drive unit relative to the driver command such as for a road speed control of for an engine drag torque control. In order to guarantee a reliable torque monitoring (and/or limiting) even during the time that such external interventions are effective, it is provided that the maximum permissible torque is compared to the desired torque formed from the external intervention. The maximum permissible torque is formed on the basis of the driver command. The larger of the two values in each case is supplied to the monitoring and/or the limiting as a permissible torque. Furthermore, an additional offset value is formed which is formed from a characteristic field in dependence upon the resulting permissible torque and the engine rpm. This offset value considers the tolerance, which is different depending upon operating state, and leads to a change of the resulting maximum permissible torque and to the consideration of the tolerance dependent upon the operating state of the engine.

Figure 2:
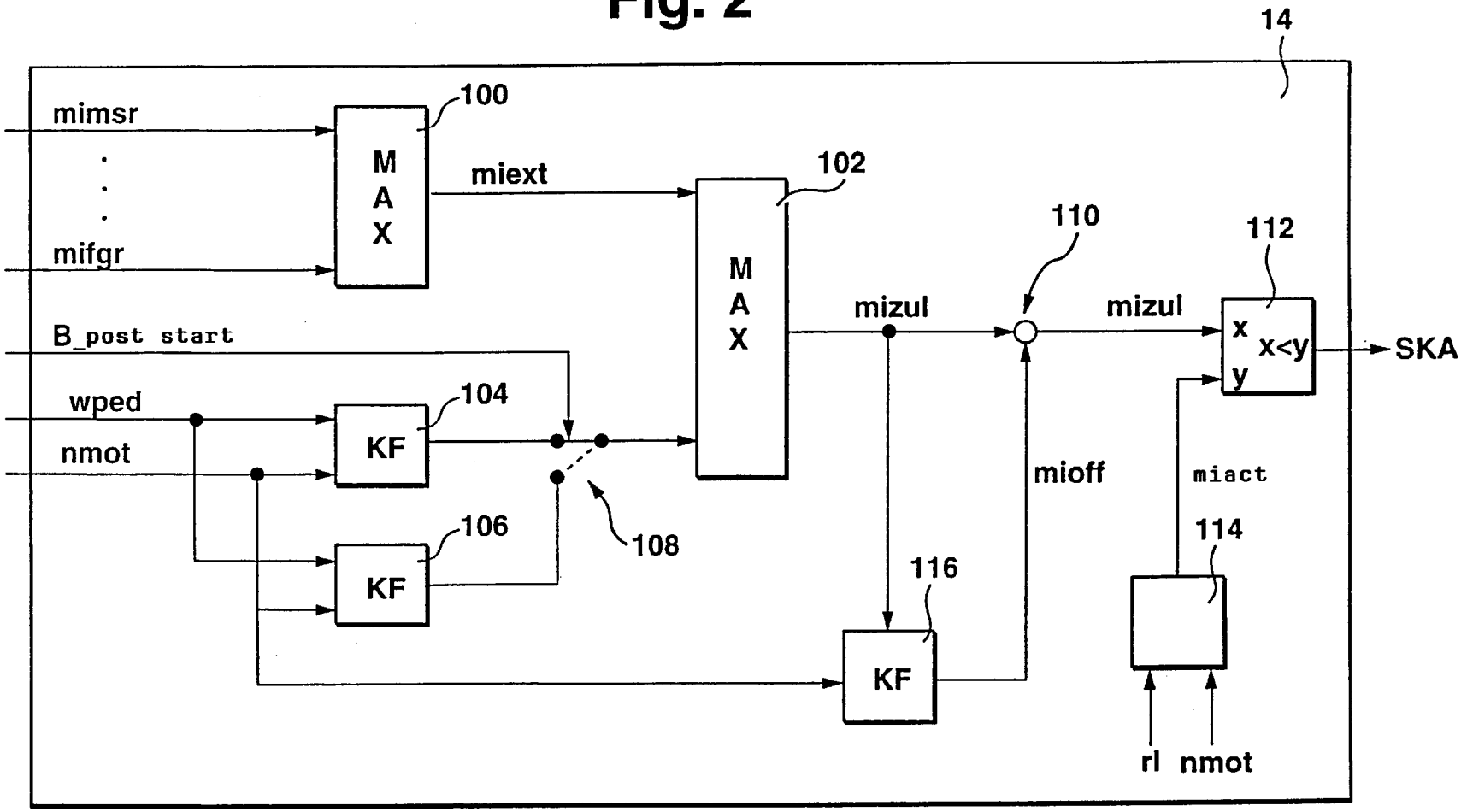

The corresponding solution is shown in FIG. 2 as a sequence diagram and represents a program which runs in the microcomputer 14.

The torque desired values, which are formed by external interventions, and which can increase the torque of the drive unit relative to the driver command are supplied to a maximum value selector 100. The torque desired values are formed, for example, by an engine drag torque control (mimsr) or a road speed control (mifgr). The particular larger one of these desired torques is transmitted in the maximum value selector 100 as desired torque miext of the external interventions. The desired torque value for the external interventions is then compared in a maximum value selector 102 to the maximum permissible torque which is formed in dependence upon the driver command. The particular larger of the two torque values is then supplied to the torque monitoring as resulting maximum permissible torque mizul. The driver command dependent maximum permissible torque is either determined in a first characteristic field 104 or in a second characteristic field 106 in dependence upon which operating state is present. The driver pedal position wped and the engine rpm nmot are supplied to both characteristic fields. In both characteristic fields, the maximum permissible torque is stored via these two input values and the characteristic field values are adapted. The poststart phase is represented by the solid line position of the switch element 108. Outside of this poststart phase, the maximum permissible torque value, which is read out of the characteristic field 104, is supplied to the maximum value selector 102 and, during the poststart phase, the maximum permissible value, which is read out of characteristic field 106, is supplied to the maximum value selector 102. The switching element 108 is switched over in dependence upon the condition for the poststart B_poststart. In the preferred embodiment, the poststart phase is present when a specific time since start has not yet elapsed, the engine temperature indicates a cold drive unit and/or the intake air temperature lies in a specific value range.

The resultant maximum permissible torque is determined in the maximum value selector 102 and is corrected in a logic element 110 to the maximum permissible torque mizul. The torque mizul is also supplied to a comparator 112. An actual torque miact is supplied to the comparator 112 which was formed in 114 in dependence upon input quantities such as the actual charge rl (which is determined in dependence on the detected air mass), the engine rpm nmot, the actual ignition angle adjustment and the fuel metering adjustment of the engine. The actual torque miact is compared in comparator 112 to the maximum permissible torque mizul. If the actual torque exceeds the maximum permissible torque, then a safety reaction SKA is triggered especially by switching off the fuel metering. The fuel metering remains cut off until the actual torque again drops below the maximum permissible torque.

The resulting maximum permissible torque is corrected by a torque offset value mioff in the logic element 110. The torque offset value mioff is read out in a characteristic field 116 in dependence upon engine rpm and the resulting maximum permissible torque, that is, the output value of the maximum value selector 102. The characteristic field values are likewise then adapted.

The tolerance values (for example, tolerances generated because of friction, component tolerances, et cetera) are stored in the characteristic field 116. The tolerance values are dependent upon the operating conditions of the drive unit. One input quantity of the characteristic field 116 is the maximum permissible torque pregiven also for external interventions. For this reason, these tolerances are also considered when external interventions operate. The offset value, which contains the tolerances, is not formed in dependence upon the accelerator pedal position so that the torque monitoring is ensured even during the intervention of external functions. Furthermore, the desired torque is not included in the formation of the maximum permissible torque so that theoretically occurring errors in the computation of the desired torque are not included in the monitoring.

In another embodiment, it is not the maximum permissible torque (that is, index of the torque command) which is considered as input quantity for the characteristic field 116 but the charge command derived therefrom as may be required (that is, the maximum permissible desired charge which is to be adjusted via the throttle flap). The monitoring is then carried out on the basis of charge values. In this sense, the use of the term torque should also be understood as being the charge as a monitoring quantity.

What is claimed is:

1. A method for controlling a drive unit of a vehicle, the method comprising the steps of:

forming a maximum permissible torque (mizul) for said drive unit in dependence upon one of the following: the position (wped) of an operator-controlled element actuable by the driver and a desired torque (miext) pregiven by at least one external function;

forming a corrective value (mioff) considering tolerances in said maximum permissible torque (mizul) for correcting said maximum permissible torque (mizul) in dependence upon the engine rpm and said maximum permissible torque (mizul) and superposing said corrective value (mioff) as an offset value on said maximum permissible torque (mizul);

comparing the corrected maximum permissible torque (mizul) to an actual torque (miact) of said drive unit; and, reducing the torque of said drive unit when the actual torque (miact) exceeds said corrected maximum permissible torque (mizul).

2. The method of claim 1, wherein said at least one external function increases the torque compared to the driver command including at least one of the following engine drive torque control and a road speed control.

3. The method of claim 1, wherein a maximum permissible torque is pregiven in dependence upon the driver command including the position of the accelerator pedal and the engine rpm and in dependence upon the operating state of the drive unit.

4. The method of claim 1, wherein in a poststart phase, another maximum permissible torque is pregiven than outside of this phase.

5. The method of claim 1, wherein in offset value is dependent upon quantities which directly define the engine torque.

6. An arrangement for controlling a drive unit of a vehicle, the arrangement comprising:

a control apparatus which includes at least one microcomputer configured to function to:

form a maximum permissible torque (mizul) of said drive unit in dependence upon one of the following; the position (wped) of an operator-controlled element actuable by the driver and a desired torque (miext) pregiven by at least one external function;

determine a corrective value (mioff) to consider tolerances in said maximum permissible torque (mizul) in dependence upon engine rpm and said maximum permissible torque (mizul) and superposing said corrective value (mioff) as an offset value on said maximum permissible torque (mizul) to correct said maximum permissible torque (mizul);

determine an actual torque (miact) of said drive unit; and, generate an output signal which reduces the torque of said drive unit when said actual torque exceeds the corrected maximum permissible torque (mizul).

* * * * *

UNITED STATES PATENT AND TRADEMARK OFFICE

CERTIFICATE OF CORRECTION

PATENT NO. : 6,285,946 B1
DATED : September 4, 2001
INVENTOR(S) : Berthold Steinmann It is certified that error appears in the above-identified patent and that said Letters Patent is hereby corrected as shown below:

Column 6,
Line 7, delete "in" and substitute -- the -- therefor.
Line 16, delete "following;" and substitute -- following: -- therefor.

Signed and Sealed this

Sixteenth Day of April, 2002

*Attest:*

*Attesting Officer*

JAMES E. ROGAN
*Director of the United States Patent and Trademark Office*